US008317351B2

(12) United States Patent
Brown et al.

(10) Patent No.: US 8,317,351 B2
(45) Date of Patent: Nov. 27, 2012

(54) KNIFE WITH A LIGHTING SYSTEM THAT INCLUDES AN INTEGRATED CIRCUIT BOARD

(75) Inventors: Barry David Brown, Shorewood, MN (US); Howard R. Tripp, Plymouth, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 13/247,232

(22) Filed: Sep. 28, 2011

(65) Prior Publication Data

US 2012/0081886 A1 Apr. 5, 2012

Related U.S. Application Data

(60) Provisional application No. 61/388,305, filed on Sep. 30, 2010.

(51) Int. Cl.
*B26B 11/00* (2006.01)

(52) U.S. Cl. ..... 362/119; 362/120; 30/158

(58) Field of Classification Search ..... 362/119–120; 30/158–159

See application file for complete search history.

(56) References Cited

U.S. PATENT DOCUMENTS

| | | | |
|---|---|---|---|
| D488,205 | S | 4/2004 | Skowronski |
| 7,008,076 | B2 | 3/2006 | Zirk et al. |
| D549,799 | S | 8/2007 | Kroll |
| 2006/0164846 | A1 | 7/2006 | Kim |

OTHER PUBLICATIONS

Gunther Gifts, Swiss Army Knives Mini-Light Knives, Jan. 25, 2011; published online at http://www.gunthergifts.com/swissarlig.html.

*Primary Examiner* — Tracie Y Green

(74) *Attorney, Agent, or Firm* — Adams Monahan, LLP; J. R. Maddox

(57) ABSTRACT

Disclosed is a knife that includes a knife blade and a tang configured for cutting a material. The tang of the knife includes a slot configured therewithin. Further, the knife includes a first handle plate. The first handle plate includes a protruding member configured therewithin. The first handle plate also includes a first cavity portion configured therewithin. Furthermore, the knife includes a second handle plate. The second handle plate includes a second cavity portion therewithin. Further, the knife includes an integrated circuit board mounted within the second cavity portion of the second handle plate. The knife also includes a holding member. The holding member is configured to receive at least one power source therewithin that is electrically coupled with the integrated circuit board. Further, the knife includes a microswitch disposed within the first cavity portion of the first handle plate. The knife also includes at least one light-emitting member.

13 Claims, 5 Drawing Sheets

KNIFE WITH A LIGHTING SYSTEM THAT INCLUDES AN INTEGRATED CIRCUIT BOARD

FIELD OF THE DISCLOSURE

The present disclosure generally relates to a knife. More particularly, the present disclosure relates to a fixed blade water-resistant knife with an integrated lighting system.

BACKGROUND OF THE DISCLOSURE

When using a knife for cutting purposes while performing activities such as filleting, field dressing and the like, a sufficient amount of light should be available to perform such activities safely and efficiently. Thus, while performing some of the activities, a user may be forced to use an additional/external source of light due to insufficient illumination. It is not always a feasible proposition to use the additional source of light for carrying out such activities due to various reasons, such as non-availability of power sources, or inconvenience of carrying the light source while performing specific activities including hunting, and the like.

For example, when a knife is used by a hunter for field dressing a hunted animal, the hunter may encounter difficulty due to non-availability of natural light. As a result, the hunter may require an additional light source. However, use of the additional light source is an inconvenient and unfeasible option because the hunter cannot hold additional objects, such as a light source, while performing the field dressing activity. Further, during field dressing there is a possibility that the additional light source may undergo damage by substances such as water, making the use of the additional light source ineffective.

Accordingly, there is a need for a water-resistant knife that may be used effectively and efficiently for cutting purposes while performing activities including filleting, field dressing and the like, without the need for any additional/external light source.

SUMMARY OF THE DISCLOSURE

In view of the foregoing, the general purpose of the present disclosure is to provide a knife with an integrated lighting system to be used for cutting purposes while performing various activities, such as filleting, field dressing and the like.

An object of the present disclosure is to provide a knife with a fixed blade and an integrated lighting system, for effectively and efficiently cutting a material while performing various activities such as filleting, field dressing and the like.

Another object of the present disclosure is to provide a knife that is water-resistant and corrosion-resistant.

Another object of the present disclosure is to provide a knife that is easy to grip while cutting various materials and performing activities such as filleting, field dressing and the like.

To achieve the above objects, the present disclosure provides a knife that includes a knife blade configured for cutting a material, and a tang. The knife includes a slot configured within the tang of the knife. Further, the knife includes a first handle plate attached on a first surface of the knife tang. The first handle plate includes a protruding member configured therewithin and facing towards the tang of the knife. The first handle plate also includes a first cavity portion configured therewithin. Furthermore, the knife includes a second handle plate attached on a second surface opposite to the first surface of the tang of the knife. The second handle plate includes a second cavity portion configured therewithin and facing towards the tang of the knife. Further, the knife includes an integrated circuit board mounted within the second cavity portion of the second handle plate. The knife also includes a holding member disposed within the protruding member of the first handle plate through the slot of the tang. The holding member is coupled with the integrated circuit board and configured to receive at least one power source therewithin. At least one power source is electrically coupled with the integrated circuit board. Further, the knife includes a micro-switch disposed within the first cavity portion of the first handle plate, and electrically coupled with the integrated circuit board. The knife also includes at least one light-emitting member configured at each of a forward-facing (meaning toward the knife blade) side portion of the first handle plate and a forward-facing side portion of the second handle plate. At least one light-emitting member is electrically coupled with the integrated circuit board. Further, each light-emitting member of at least one light-emitting member is configured to emit light when the micro-switch is actuated (turned on). In the preferred embodiment of the knife, all components of the knife are waterproof. In other embodiments, some components are waterproof and others are not. In all embodiments, the electrical components of the disclosed knife are waterproof or encased within a waterproof or water-sealed handle plate or plates.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of the drawings.

DETAILED DESCRIPTION OF THE DISCLOSURE

The exemplary embodiments described herein in detail for illustrative purposes are subject to many variations in structure and design. It should be emphasized, however, that the present disclosure is not limited to a particular knife, as shown and described. It is understood that various omissions and substitutions of equivalents are contemplated as circumstances may suggest or render expedient, but these are intended to cover the application or embodiments without departing from the spirit or scope of the claims of the present disclosure. Also, it is to be understood that the phraseology and terminology used herein are for the purpose of description and should not be regarded as limiting.

The use of "including," "comprising," or "having" and variations thereof herein is meant to encompass the items listed thereafter and equivalents thereof as well as additional items. Further, the terms, "a" and "an" herein do not denote a limitation of quantity, but rather denote the presence of at least one of the referenced item. Unless limited otherwise, the terms "attached," "coupled," and variations thereof herein are used broadly and encompass direct and indirect attachments and couplings.

The present disclosure provides a knife with an integrated lighting system, for cutting purposes while performing various activities including, but not limited to, filleting, field dressing and the like. The knife of the present disclosure includes a knife blade configured for cutting a material, a tang, a first handle plate attached on a first surface of the knife tang, a second handle plate attached on a second surface opposite to the first surface of the knife tang, an integrated circuit board, a holding member configured to receive at least one power source therewithin, a micro-switch electrically coupled with the integrated circuit board, and at least one light-emitting member configured at each of a forward-facing side portion of the first handle plate and a forward-facing side portion of the second handle plate. In the preferred embodiment, the tang of the knife is approximately the entire length of the first and second handle plates. The knife of the present disclosure is explained in detail in conjunction with FIGS. 1-7.

Figure 1:
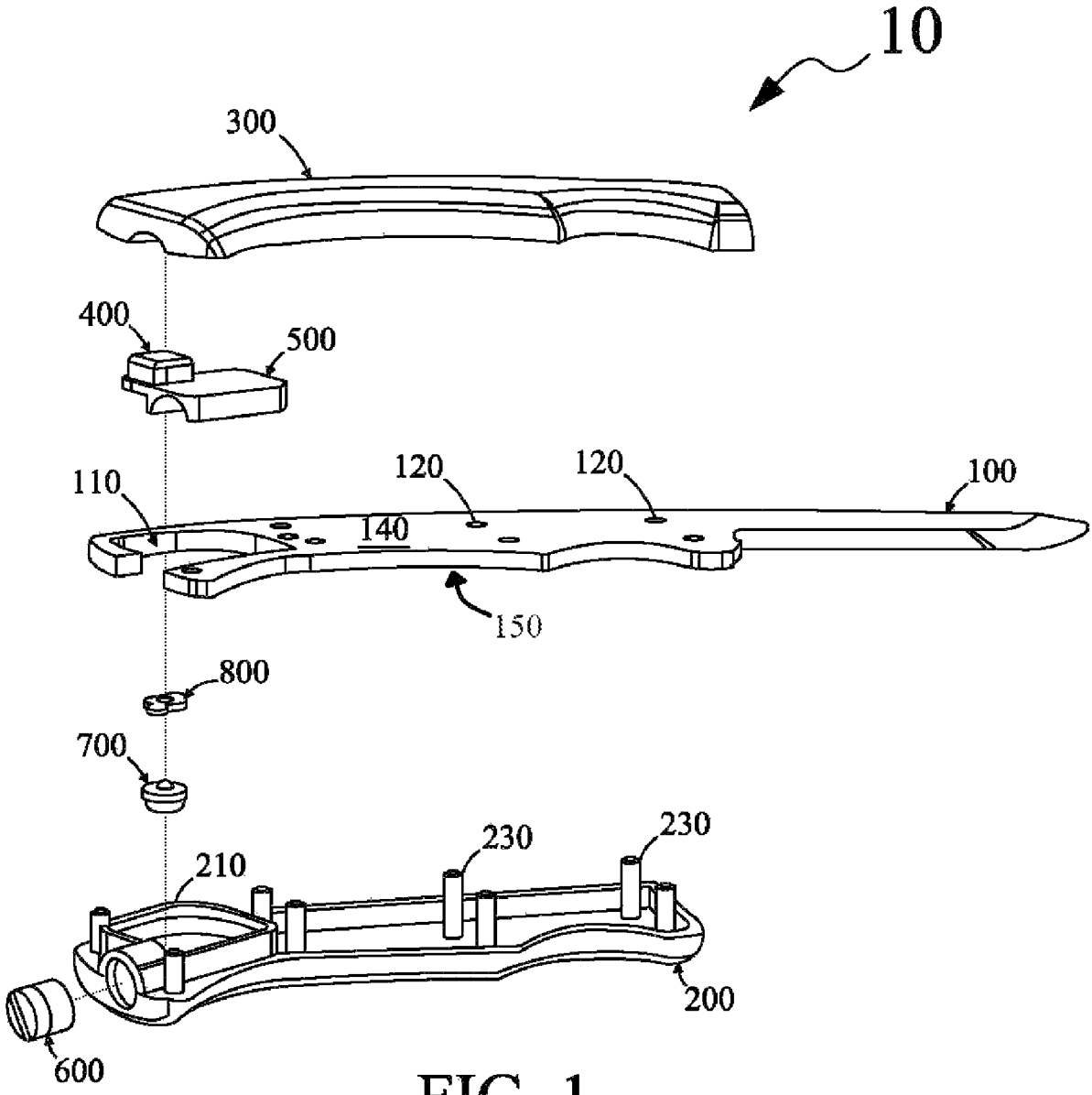
FIG. 1 illustrates an exploded view of a knife, in accordance with an embodiment of the present disclosure.

FIG. 1 illustrates an exploded view of a knife 10 of the present disclosure. The knife 10 includes a knife blade 100 configured for cutting a material, such as the body of an animal. The knife blade 100 further includes a slot 110 configured therewithin. Specifically, the slot 110 is configured at an end portion (not numbered) of a tang 150 of the knife blade 100. The knife tang 150 also includes a plurality of apertures 120 configured therewithin. More specifically, the apertures 120 are configured within the tang 150 of the knife 10 as illustrated in FIG. 1.

Further, the knife blade 100 and tang 150 may be made by a suitable forging process or any other process as known in the art, so as to provide a sharp edge for efficient and effective cutting purposes. The knife blade 100 and tang 150 may be made of a strong material, including but not limited to, stainless steel, carbon steel, an alloy of iron and carbon, and the like. Also, the knife blade 100 of the knife 10 as disclosed in the present disclosure is of a fixed type (fixed with reference to other components of the knife 10), thereby providing additional strength to the knife 10 while the knife 10 is held by a user for cutting any material. Further, the knife blade 100 may be coated with a corrosion-resistant material such as titanium nitride for increased durability and surface hardness of the knife blade 100. The knife blade 100 and tang 150 are provided with an ergonomic shape so as to be easily carried by the user and to allow a firm grip. It is understood that the material, shape, and size of the knife 10 and other disclosed components should not be considered as a limitation to the present disclosure. Further, the slot 110 and the apertures 120 may be formed within the tang 150 by any suitable process as known in the art.

Figure 2:
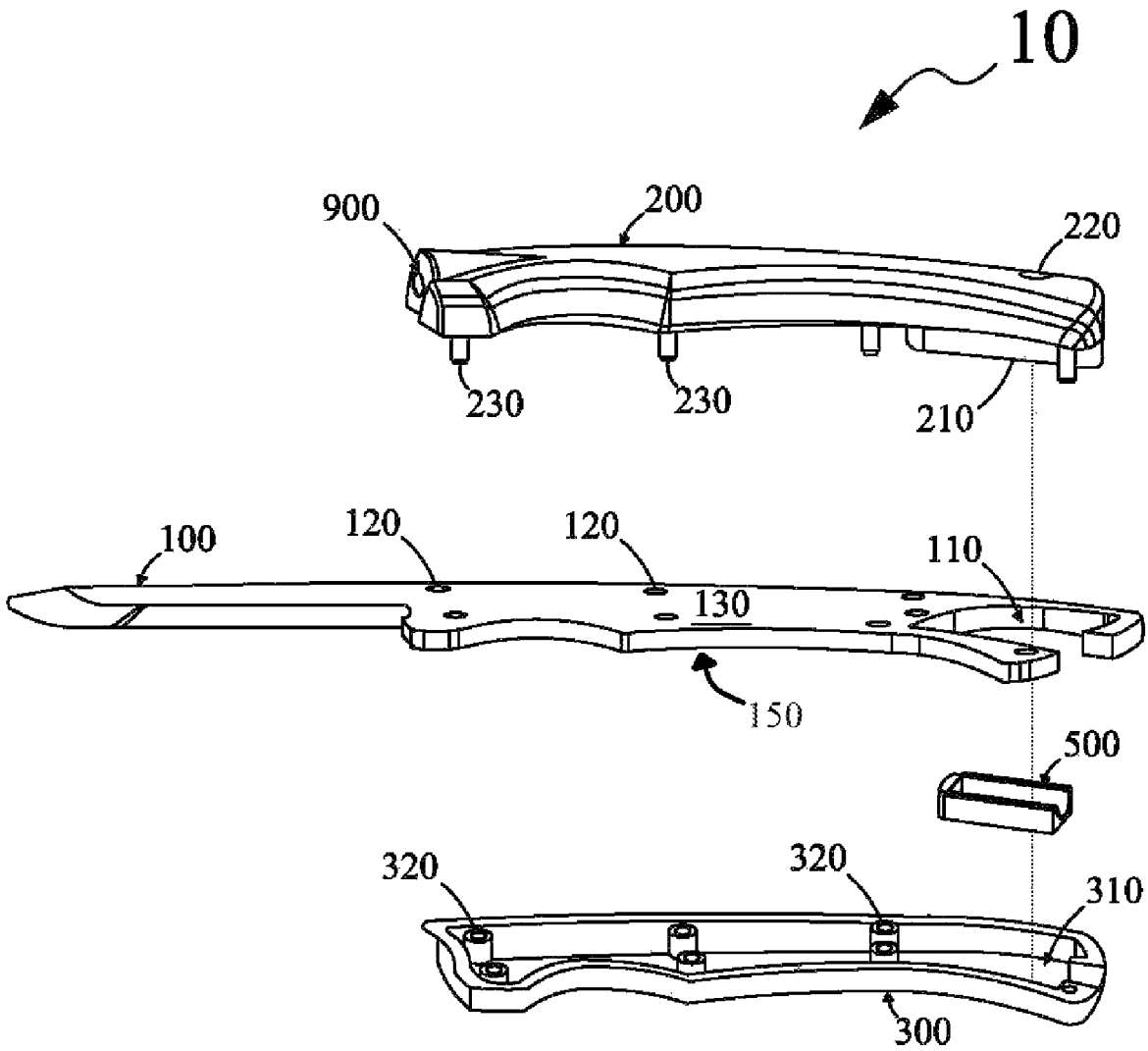
FIG. 2 illustrates another exploded view of the knife of FIG. 1, in accordance with an embodiment of the present disclosure.

Referring to FIGS. 1 and 2, the knife 10 further includes a first handle plate 200 attached on a first surface 130 of the tang 150. More specifically, the first handle plate 200 is attached on the tang 150 of the knife 10 and conforms to the shape of the tang 150. The first handle plate 200 may be attached by any suitable means as known in the art. Further, the first handle plate 200 may either be fixedly or removably attached to the tang 150 of the knife 10. The first handle plate 200 is ergonomically designed, thereby making it easier for the user to firmly grip the knife 10 with the help of his/her fingers and reducing likelihood of strain on the wrist. The first handle plate 200 may be made of a water-resistant strong material, including, but not limited to, a plastic material, a rubberized material and the like.

Further, the first handle plate 200 includes a protruding member 210 configured therewithin and facing towards the knife blade 100 as illustrated in FIGS. 1 and 2. The protruding member 210 is configured on the first handle plate 200 in a manner such that the protruding member 210 is in alignment with the slot 110 of the tang 150 when the first handle plate 200 is attached to the knife blade 100 at the tang 150 during the manufacturing of the knife 10. More specifically, the protruding member 210 protrudes away from an inner surface (not numbered) of the first handle plate 200 and towards the tang 150 in a vertical orientation. Further, the protruding member 210 may have any shape and dimension based on the shape and dimension of the slot 110.

Additionally, the first handle plate 200 includes a first cavity portion 220 configured therewithin, as illustrated in FIGS. 2, 3, 4 and 6. The first cavity portion 220 may be a circularly shaped cavity portion. More specifically, the first cavity portion 220 is positioned and shaped in such a manner that the first cavity portion 220 is easily accessible by fingers of the user while operating the knife 10. Accordingly, the first cavity portion 220 may be configured to have any shape and dimension suitable for the aforementioned purposes. Also, the first cavity portion 220 may be formed by any suitable process as known in the art.

Further, the first handle plate 200 includes a plurality of first locking members 230 (hereinafter referred to as "locking members 230") configured therewithin and facing towards the tang 150, as illustrated in FIGS. 1 and 2. The locking members 230 are integral to the first handle plate 200. Further, the locking members 230 are cylindrical in shape and are utilized while the first handle plate 200 is attached to the tang 150. However, it will be evident that the locking members 230 may have any other suitable shape and dimension. The locking members 230 protrude outwards from the inner surface of the first handle plate 200 towards the tang 150. More specifically, the locking members 230 aid in keeping the first handle plate 200 intact with the tang 150 as illustrated in FIGS. 3-7.

Referring again to FIG. 1, the knife 10 includes a second handle plate 300 attached on a second surface 140 opposite to the first surface 130 of the tang 150. The second handle plate 300 is similar in structure to the first handle plate 200. More specifically, the second handle plate 300 is attached on the tang 150 of the knife blade 100 in a similar fashion as the first handle plate 200 while conforming to the shape of the tang 150. The second handle plate 300 may be attached by any suitable means as known in the art. Further, the second handle plate 300 may be either fixedly or removably attached to the tang 150 of the knife 10. The second handle plate 300 is ergonomically designed, thereby making it easier for the user to firmly grip the knife 10 with the help of his/her fingers and reducing likelihood of strain on the wrist. The second handle plate 300 may be made of a water-resistant strong material including, but not limited to, a plastic material, a rubberized material and the like.

Further, the second handle plate 300 includes a second cavity portion 310 therewithin and facing towards the tang 150 as illustrated in FIG. 2. The second cavity portion 310 is configured in conformation with the shape and size of the slot 110 of the tang 150.

The second handle plate 300 further includes a plurality of second locking members 320 (hereinafter referred to as "locking members 320") configured therewithin facing towards the tang 150. Each of the locking members 320 is integral to the second handle plate 300, and is configured to receive a corresponding locking member of the locking members 230 of the first handle plate 200 therewithin through a corresponding aperture of the apertures 120 of the tang 150, in order to form a lock and to attach the first handle plate 200, the tang 150 and the second handle plate 300. For example, when the first handle plate 200 is attached to the tang 150, then the locking members 230 exactly pass through the apertures 120 of the tang 150 and are received by the locking members 320 of the second handle plate 300 attached to the tang 150 on the opposite side of the first handle plate 200. Further, the locking members 230 and the locking members 320 disclosed in the present disclosure are utilized for locking the tang 150 and knife blade 100 therebetween. After the coupling of the locking members 230 with the locking members 320, the locking members 230 and the locking members 320 are sonically welded to form a permanent bond. Alternatively, any other locking mechanism, such as nut and bolt arrangement and a screw arrangement as available in the art, may also be utilized to establish the aforementioned attachment of the first handle plate 200, the tang 150 of the knife 10 and the second handle plate 300.

Referring again to FIG. 1, the knife 10 includes an integrated circuit (IC) board 400. The IC board 400 is mounted within the second cavity portion 310 of the second handle plate 300. The IC board 400 is used to channel a plurality of wires. The IC board 400 as disclosed in the present disclosure may be a typical IC board available in the market. The size and shape of the IC board 400 is such that the IC board 400 is easily received within the second cavity portion 310 of the second handle plate 300.

Further, the knife 10 includes a holding member 500 as illustrated in FIGS. 1 and 2. In the preferred embodiment, the holding member 500 is disposed within the protruding member 210 of the first handle plate 200 through the slot 110 of the tang 150. In other embodiments, the knife 10 may be constructed with a partial tang and the holding member 500 is disposed between the first handle plate 200 and the second handle plate 300 in a space below the tang. In all embodiments, the holding member 500 is coupled with the IC board 400, and configured to receive at least one power source (not shown) that is electrically coupled with the IC board 400. The power source may be in the form of one or more batteries, and more specifically, three or four sets of batteries. Accordingly, the holding member 500 receives one or more batteries (as per requirement), and acts as an enclosed compartment for the received one or more batteries. Also, the one or more batteries as utilized in the present disclosure may be typical batteries easily available in the market. The shape and size of the holding member 500 is such that the holding member 500 easily gets fitted within the protruding member 210 of the first handle plate 200. It is to be understood that the shape and size of the holding member 500 should not be considered as a limitation to the present disclosure. Further, the holding member 500 may be made of a suitable material as known in the art to hold the one or more batteries therewithin.

Figure 6:
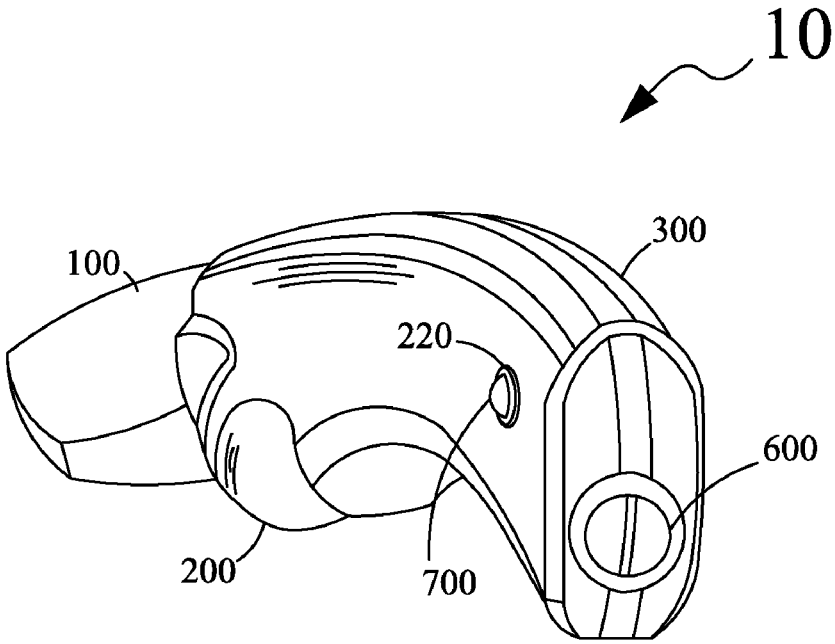
FIG. 6 illustrates a left rear view of the knife of FIGS. 1 and 2, in accordance with an embodiment of the present disclosure.
Figure 7:
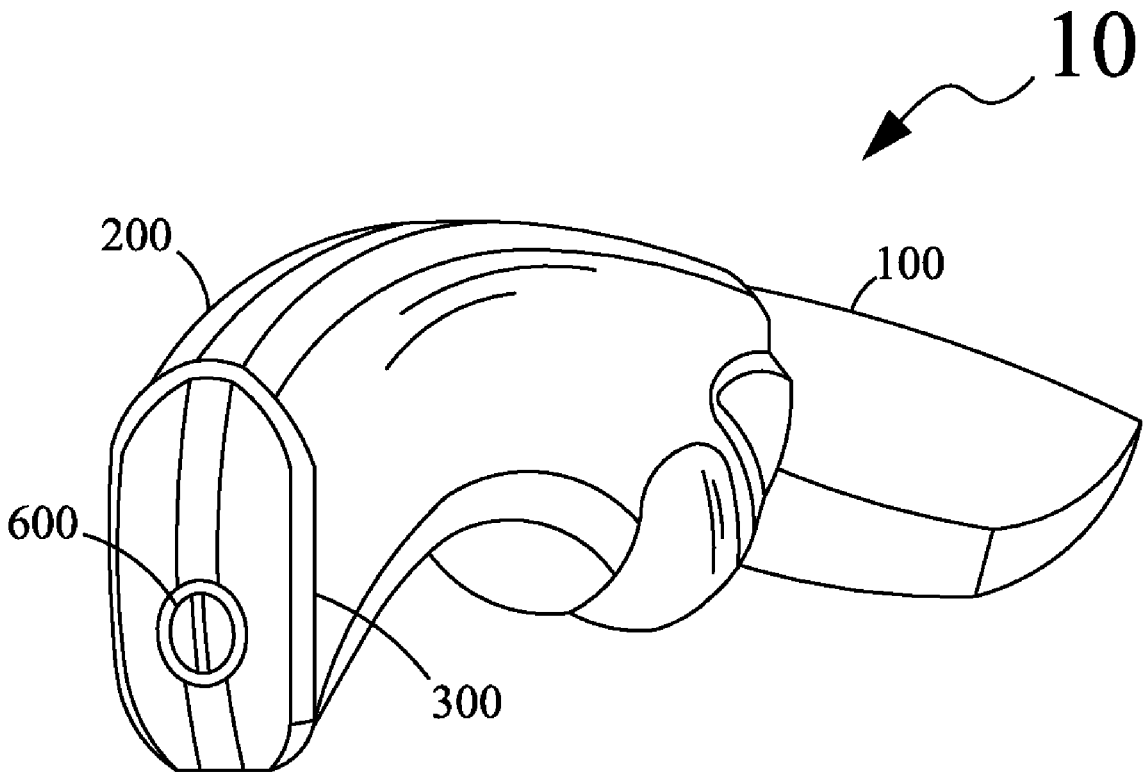
FIG. 7 illustrates a right rear view of the knife of FIGS. 1 and 2, in accordance with an embodiment of the present disclosure.

Additionally, the knife 10 includes a screw cap 600 as illustrated in FIGS. 1, 6 and 7. The screw cap 600 is utilized to screw the holding member 500 disposed/configured within the protruding member 210 of the first handle plate 200 with the first handle plate 200. The screw cap 600 as disclosed in the present disclosure also prevents water from entering inside the protruding member 210 with the help of an o-ring member (not numbered) provided with the screw cap 600 as illustrated in FIGS. 1 and 2. The o-ring member may be either removably or fixedly attached on the screw cap 600.

Referring to FIGS. 1, 3, 4, and 6, the knife 10 includes a micro-switch 700. The micro-switch 700 is disposed within the first cavity portion 220 of the first handle plate 200. Further, the micro-switch 700 is electrically coupled with the IC board 400. It may be understood that the micro-switch 700 may be installed onto the IC board 400. The micro-switch 700 is water-sealed thereby, making the micro-switch 700 effectively water-resistant. Further, the micro-switch 700, when pressed during the use of the knife 10, acts as a connecting medium carrying the electrical current between the one or more batteries and the IC board 400. The micro-switch 700 as disclosed in the present disclosure may be a typical micro-switch such as a recessed rubber micro-switch available in the market.

Further, the knife 10 includes a micro-switch plate 800 as illustrated in FIG. 1. The micro-switch plate 800 supports the micro-switch 700 configured within the first cavity portion 220 of the first handle plate 200. The micro-switch plate 800 is either removably or fixedly attached at an end portion (not numbered) of the micro-switch 700. The micro-switch plate 800 may be made of a durable material so as to be capable of supporting the micro-switch 700 for a longer duration.

Referring to FIGS. 2-5, the knife 10 also includes at least one light-emitting member 900 configured at each of a forward-facing (meaning toward, or along the length of, the knife blade 100) side portion (not numbered) of the first handle plate 200 and a forward-facing (meaning toward, or along the length of, the knife blade 100) side portion (not numbered) of the second handle plate 300. Each light-emitting member 900 is configured to emit light down the length of the knife blade 100 and, in some embodiments, beyond the end of the knife blade 100. Further, at least one light-emitting member 900 is electrically coupled with the IC board 400. More specifically, at least one light-emitting member 900 is soldered to first end portions of connecting wires (not shown), and second end portions opposite to the first end portions of the connecting wires are soldered to the IC board 400. For the purpose of this description, each light-emitting member of at least one light-emitting member 900 is a light-emitting diode (LED) adapted to emit any type/color of light visible to the user of the knife 10.

Further, each light-emitting member of at least one light-emitting member 900 is configured to emit light when the micro-switch 700 is actuated (turned-on) while cutting the material. Each light-emitting member of at least one light-emitting member 900 is water-sealed, thereby making each light-emitting member of at least one light-emitting member 900 workable in water. Each light-emitting member of at least one light-emitting member 900 may be water-sealed by a suitable material as known in the art. Thus, each light-emitting member of at least one light-emitting member 900 may be in the form of water-sealed LED bulbs as known in the art, focusing light around a cutting area. Further, each light-emitting member of at least one light-emitting member 900 is configured to emit light of known frequency as available in the visible spectrum of electromagnetic radiation. Furthermore, each light-emitting member of at least one light-emitting member 900 may emit light of high intensity, thereby adequately illuminating the cutting area while any material is cut.

It will be evident that the knife 10 and various components thereof may be configured to have different shapes, sizes, and configurations for use in performing specific cutting tasks, such as field dressing, capping, filleting fish, and the like.

Figure 3:
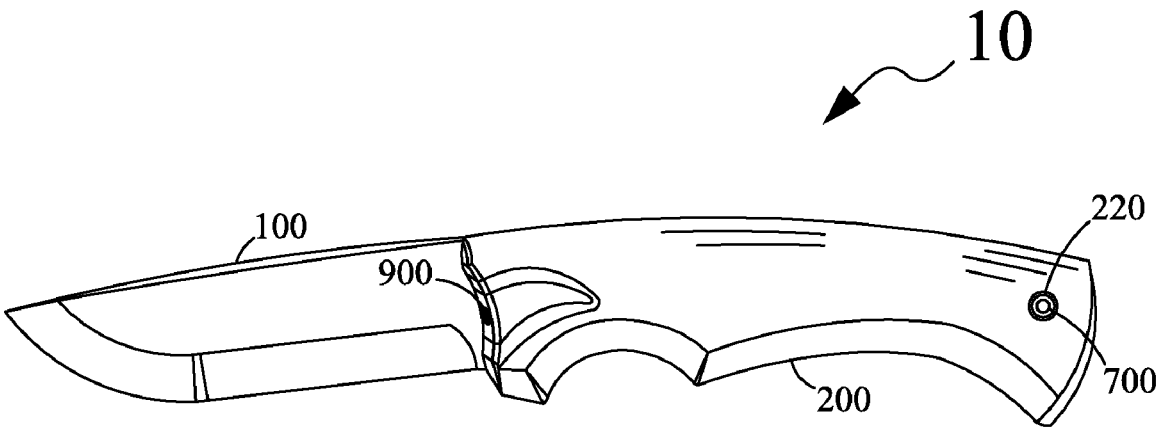
FIG. 3 illustrates a left side view of the knife of FIGS. 1 and 2, in accordance with an embodiment of the present disclosure.
Figure 4:
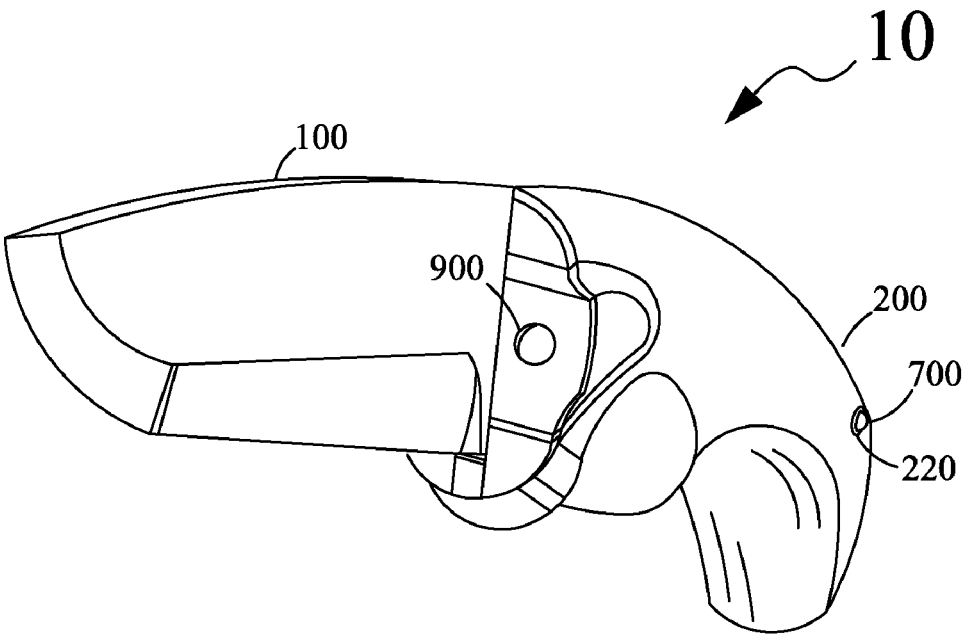
FIG. 4 illustrates a left front view of the knife of FIGS. 1 and 2, in accordance with an embodiment of the present disclosure.
Figure 5:
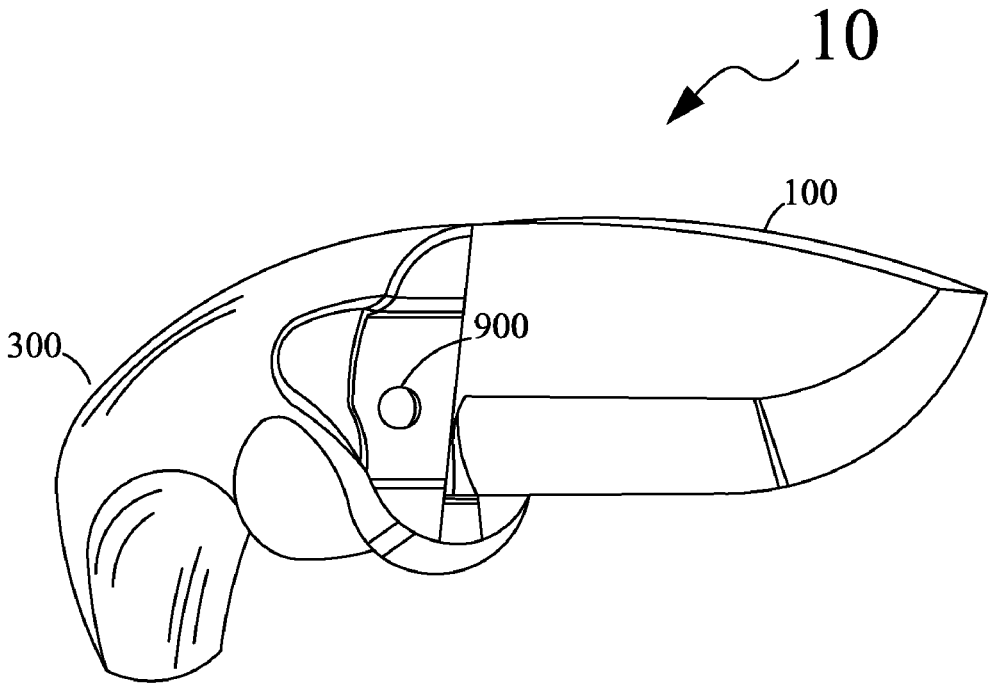
FIG. 5 illustrates a right front view of the knife of FIGS. 1 and 2, in accordance with an embodiment of the present disclosure.

Referring to FIG. 3, in use, a hunter while either field dressing (such as to work within a cavity of a hunted animal by cutting away internal organs of the hunted animal) or cutting a material, presses and actuates the micro-switch 700 as located on the knife 10. The pressing/actuation of the micro-switch 700 assists in establishing an electrical connection between the IC board 400 and at least one power source through a plurality of connecting wires. The IC board 400 is further electrically coupled to each light-emitting member of at least one light-emitting member 900 providing an electrical current to each light-emitting member of at least one light-emitting member 900. Accordingly, each light-emitting member of at least one light-emitting member 900 emits light along the length of the knife blade 100 onto the material required to be cut. Further, each light-emitting member of at least one light-emitting member 900 provides adequate light onto and around the cutting area.

The present disclosure provides an efficient and effective water-resistant knife, such as the knife 10, with an integrated lighting system for appropriately and adequately illuminating a cutting area while performing activities such as field dressing. Specifically, the knife of the present disclosure assists in cutting a material, in a manner wherein one or more light-emitting members of the knife emit light down the length of the knife blade and further provide light onto and around the cutting area. Further, the knife 10 as disclosed in the present disclosure includes a fixed knife blade for use in performing specific cutting tasks, such as capping, filleting fish and the like, secured by the tang of the knife blade which, in the preferred embodiment, runs the length of the handle plates.

The foregoing descriptions of specific embodiments of the present disclosure have been presented for purposes of illustration and description. They are not intended to be exhaustive or to limit the present disclosure to the precise forms disclosed, and of course many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. A knife comprising:

a knife blade configured for cutting a material with a tang extending to the base of the handle, the tang comprising a slot configured therewithin;

a first handle plate attached on a first surface of the tang of the knife, the first handle plate comprising, a protruding member configured therewithin and facing towards the tang, and a first cavity portion configured therewithin;

a second handle plate attached on a second surface opposite to the first surface of the tang of the knife, the second handle plate comprising a second cavity portion configured therewithin and facing towards the tang;

an integrated circuit board mounted within the second cavity portion of the second handle plate;

a holding member disposed within the protruding member of the first handle plate through the slot of the tang, the holding member being coupled with the integrated circuit board and configured to receive at least one power source therewithin, wherein the at least one power source is electrically coupled with the integrated circuit board;

a micro-switch disposed within the first cavity portion of the first handle plate and electrically coupled with the integrated circuit board; and at least one light-emitting member configured at each of a forward-facing side portion of the first handle plate and a forward-facing side portion of the second handle plate, configured to emit light along the knife blade, and electrically coupled with the integrated circuit board, each light-emitting member of the at least one light-emitting member configured to emit light when the micro-switch is actuated.

2. The knife of claim 1 further comprising a micro-switch plate for supporting the micro-switch configured within the first cavity portion of the first handle plate.

3. The knife of claim 1 further comprising a screw cap for screwing the holding member disposed within the protruding member of the first handle plate.

4. The knife of claim 3 further comprising an o-ring member removably attached on the screw cap.

5. The knife of claim 1, wherein the tang of the knife further includes a plurality of apertures configured therewithin.

6. The knife of claim 1, wherein the first handle plate further includes a plurality of first locking members configured therewithin and facing towards the tang of the knife.

7. The knife of claim 6, wherein the second handle plate further comprises a plurality of second locking members configured therewithin, each locking member of the plurality of second locking members being configured facing towards the tang of the knife for receiving a corresponding locking member of the plurality of first locking members.

8. The knife of claim 1, wherein the each light-emitting member of the at least one light-emitting member is a water-sealed member.

9. The knife of claim 1, wherein the knife blade is coated with a corrosion-resistant material.

10. The knife of claim 1, wherein the micro-switch is a water-sealed micro-switch.

11. The knife of claim 1, wherein the at least one light emitting member, the micro-switch, the at least one power source, and the associated electrical couplings for the aforementioned electrical components of the knife are waterproof, water-sealed or water-resistant.

12. The knife of claim 1, wherein the first handle plate and the second handle plate are made of a rubberized material.

13. The knife of claim 1, wherein the first handle plate and the second handle plate are made of a plastic material.

* * * * *